US007182127B2

(12) United States Patent
Oh et al.

(10) Patent No.: US 7,182,127 B2
(45) Date of Patent: Feb. 27, 2007

(54) HEAT EXCHANGER

(75) Inventors: Sai Kee Oh, Seoul (KR); Cheol Soo Ko, Goonpo-si (KR); Dong Yeon Jang, Siheung-si (KR); Yong Cheol Sa, Anyang-si (JP); Se Yoon Oh, Seoul (KR); Baik Young Chung, Incheon-si (KR)

(73) Assignee: LG Electronics Inc., Seoul (KR)

( * ) Notice: Subject to any disclaimer, the term of this patent is extended or adjusted under 35 U.S.C. 154(b) by 453 days.

(21) Appl. No.: 10/754,509

(22) Filed: Jan. 12, 2004

(65) Prior Publication Data

US 2005/0045316 A1 Mar. 3, 2005

(30) Foreign Application Priority Data

Sep. 2, 2003 (KR) ..... 10-2003-0061151

(51) Int. Cl.
*F28F 1/32* (2006.01)

(52) U.S. Cl. ..... 165/151; 165/DIG. 504

(58) Field of Classification Search ..... 165/151, 165/182

See application file for complete search history.

(56) References Cited

U.S. PATENT DOCUMENTS 4,923,002 A * 5/1990 Haussmann ..... 165/151
5,207,270 A * 5/1993 Yokoyama et al. ..... 165/151
5,353,866 A 10/1994 Ueda et al.
5,738,168 A * 4/1998 Patel et al. ..... 165/151
5,752,567 A * 5/1998 Obosu ..... 165/151
5,927,393 A * 7/1999 Richter et al. ..... 165/151
2005/0056407 A1* 3/2005 Oh et al. ..... 165/151
2006/0005956 A1* 1/2006 Kester ..... 165/151

FOREIGN PATENT DOCUMENTS

JP 56023699 A * 3/1981
JP 61153498 A * 7/1986
JP 64006699 A * 1/1989
JP 02029597 A * 1/1990
JP 05045085 A * 2/1993
KR 1993-0000661 B1 10/1993

* cited by examiner

*Primary Examiner*—Allen J. Flanigan
(74) *Attorney, Agent, or Firm*—Birch, Stewart, Kolasch & Birch, LLP

(57) ABSTRACT

A heat exchanger includes a plurality of tubes through which refrigerants flow, the tubes being spaced apart from each other, and a plurality of fins spaced apart from each other at a predetermined distance. Each of the fins has fin collars through which the tubes are perpendicularly inserted, seat portions concentrically formed around outer circumferences of the fin collars and provided with laterally-opened front and rear portions, more than two peak portions, and more than two valley portions, the peak and valley portions being alternately disposed to provide airflow variation.

20 Claims, 10 Drawing Sheets

HEAT EXCHANGER

This Nonprovisional application claims priority under 35 U.S.C. § 119(a) on patent application No(s). 10-2003-0061151 filed in KOREA on Sep. 2, 2003, the entire contents of which are hereby incorporated by reference.

BACKGROUND OF THE INVENTION

1. Field of the Invention

The present invention relates to a heat exchanger, and more particularly, to a heat exchanger that is designed to reduce flow-resistance of air introduced into a fin collar region of a corrugate fin and to provide a uniform airflow speed distribution to the fin.

2. Description of the Related Art

Generally, a heat pump type air conditioner is operated in a cooling mode when an indoor temperature is higher than a predetermined level and is operated in a heating mode when the indoor temperature is lower than the predetermined level. At this point, when the air conditioner is operated in the heating mode, a heat exchanger of the air conditioner functions as an evaporator.

FIG. 1 shows a conventional heat pump type air conditioner.

Referring to FIG. 1, the heat pump type air conditioner is operated in cooling and heating modes according to an indoor temperature.

In the cooling mode, refrigerant gas pumped out from a compressor 1 is separated from oil while passing through an oil separator 2, which is then directed to an outdoor heat exchanger 4 through a four-way valve 3. The refrigerant gas directed to the outdoor heat exchanger is phase-transited into a low-temperature low-pressure state while passing through an expansion valve 5 and is then directed to an indoor heat exchanger 6. The refrigerant gas vaporized in the indoor heat exchanger 6 is heat-exchanged with indoor air and is then directed to an accumulator 7 through the four-way valve 3. The refrigerant gas directed to the accumulator 7 is directed into the compressor 1 for the same circulation.

In a heating mode, the refrigerant gas pumped out from the compressor 1 is separated from oil while passing through the oil separator 2, which is then directed to the indoor heat exchanger 6 through the four-way valve 3 to thereby be condensed to heat-exchange with indoor air. The condensed refrigerant gas is then changed into a low-temperature low-pressure state while passing through the expansion valve 5 and is vaporized while passing through the heat exchanger 4. The vaporized refrigerant gas is directed to the accumulator 7 through the four-way valve 3. The refrigerant gas directed to the accumulator 7 is directed into the compressor 1 for the circulation.

FIG. 2 shows a conventional heat exchanger 4, and FIG. 3 shows a state where frost is formed on a surface of a fin.

Referring to FIGS. 2 and 3, the heat exchanger 4 includes a heat exchanging member 8 for performing a heat exchange between the refrigerant and outdoor air, a blower fan 9 for sucking and discharging the outdoor air for the heat exchange of the heat exchanging member 8.

At this point, the outdoor air discharged by the blower fan 9 passes through an air passage defined between flat fins 11 fixed on tubes 10. In the heating mode, frost is formed on the surfaces of the fins 11 fixed on the tube 10. Here, the frost 12 formed on the flat fins 11 is relatively thick at the front end of the flat fin 11 where a relatively large amount of air flows, and the thickness of the frost 12 is gradually reduced as it goes toward a rear end of the flat fin 11.

The heat exchangers 8 are classified into several types according to a type of cooling fin arranged on the tubes. Most widely used is a corrugate fin type.

FIG. 4 shows a conventional corrugate fin type heat exchanger.

Referring to FIG. 4, a heat exchanger 101 includes a plurality of W-shaped corrugate fins 110 spaced away from each other at a predetermined distance and a plurality of tubes disposed perpendicularly penetrating the corrugate fins 110. Refrigerant flows along the tubes 130.

The fin 110 includes peak and valley portions 112 and 114 that are alternately formed on a region, where the tubes 130 are not penetrating, and connected to each by longitudinal inclined sections, fin collars 116 through which the tubes 130 are inserted, longitudinal axes of the tubes being perpendicularly penetrating a longitudinal centerline of the fin 110, and seat portions 118 for supporting the fin collars 116.

The heat exchanger having such corrugate fins will be described more in detail hereinafter with reference to FIGS. 4 to 7.

Referring to FIG. 4, the heat exchanger 101 is a fin-tube type having the plurality of fins 110 through which two rows of tubes 130 penetrate at right angles.

Each of the fins 110 has a plurality of donut-shaped flat portions and a plurality of longitudinal inclined sections that are defined by the W-shape having a plurality of the peak and valley portions 112 and 114. The fins 110 are installed on the tubes 130 in a longitudinal direction of the tubes 130, being spaced away from each other at a predetermined distance.

Referring to FIGS. 5 and 6, there is shown a detailed structure of the fin 110. The fin 110 is formed having a W-shape with the peak and valley portions 112 (112*a* and 112*b*) and 114 (114*a*, 114*b* and 114*c*) that are alternately formed. That is, the fin 110 has two side ends that are respectively defined by the valley portions 114*a* and 114*c*. The fin 110 can be formed in a multiple fin structure combining a plurality of fins to each other side by side. In order to improve the heat exchange efficiency, the tubes are arranged in a zigzag-shape.

That is, each of the fins 110 installed on the tube 130 has two peak portions 112*a* and 112*b* and three valley portions 114*a*, 114*b* and 114*c*, which are alternately disposed and connected by inclined sections. The shape of the fin 110 is symmetrical based on the longitudinal center valley portion 114*b*. Central axes of the tube 130 pass through the longitudinal center valley portion 114*b*.

The fin 110 is provided with a plurality of tube insertion holes 116*a*, whose central axes correspond to the respective central axes of the tubes 130. The fin collars 116 are elevated from the fin 110 to define the tube insertion holes 116*a* through which the tubes 130 are inserted. The tube 130 surface-contacts an inner circumference of each fin collar 116. The seat portion 118 is formed around a lower end of an outer circumference of the fin collar 116 to support the fin collar 116 and to allow air to flow in the form of enclosing the tube 130 and the fin collar 116.

An inclined portion 120 is formed on the fin 110 around the seat portion 118 to prevent the air flowing around the tube 130 from getting out of a circumference of the tube 130. The inclined portion 120 is inclined upward from the seat portion 18 to the peak portions 112.

In addition, the seat portion 118 is located on a horizontal level identical to that where the valley portions 114 are located. Heights and depths H1 of the peak and valley portions 112 and 114 are identical to each other. In addition, the inclined angles of the longitudinal inclined sections connecting the valley portions to the peak portions are also identical to each other.

When the air is introduced into the heat exchanger 101, since the seat portions 118 and the valley portions 114 are located on an identical horizontal plane, the air flowing around the tubes cannot reach the rear ends of the tubes. In addition, the growth of frost formed on an outer surface of the fin 110 is proportional to an amount of a heat transfer on the outer surface of the fin 110. The airflow speed is increased at the fin regions between the tubes, thereby forming a high-speed airflow. As a result, the heat transfer coefficient is increased and the frost layer is quickly grown on the surface of the fin 110 as shown in FIG. 3.

When the frost layer is grown on the surface of the fin 110, since the distance between the adjacent fins 110 is reduced, an air passage area is also reduced. By the reduced area, the airflow speed is increased, as the result of which the pressure drop of the air is increased in the form of a parabola as time elapses and the heat transfer amount of the heat exchanger is also greatly reduced.

In addition, the air flowing around the tubes is accumulated at the rear ends of the tubes, deteriorating the heat transfer efficiency. That is, since the seat portions and the valley portions are located on the identical horizontal plane, the air cannot sufficiently reach the rear ends of the tubes. As a result, a wake region where the air is accumulated is formed on the rear ends, thereby deteriorating the heat transfer efficiency.

Therefore, there is a need for guiding high-speed airflow up to the rear ends of the tubes where the wake region is formed.

SUMMARY OF THE INVENTION

Accordingly, the present invention is directed to a heat exchanger that substantially obviates one or more problems due to limitations and disadvantages of the related art.

A first object of the present invention is to provide a heat exchanger that can reduce the wake region formed in a rear end of a tube by opening front and rear portions of a seat portion formed around a lower end of an outer circumference of a fin collar, thereby solving the accumulation problem of the air at the wake region and reducing the airflow-resistance.

A second object of the present invention is to provide a heat exchanger having a seat portion formed around a lower end of an outer circumference of a fin collar and provided with opened front and rear portions to provide a uniform airflow speed distribution through an overall surface of the fin, thereby improving the heat exchange efficiency.

A third object of the present invention is to provide a heat exchanger that can improve the heat exchange efficiency by forming a longitudinal center valley to be higher than a seat portion to enlarge an air passage area defined between the fins.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a heat exchanger comprising a plurality of tubes through which refrigerants flow, the tubes being spaced away from each other at a predetermined distance; and a plurality of fins spaced away from each other at a predetermined distance, each of the fins having fin collars through which the tubes are perpendicularly inserted, seat portions each concentrically formed around outer circumferences of the fin collars and provided with laterally-opened front and rear portions, more than two peak portions, and more than two valley portions, the peak and valley portions being alternately disposed to provide airflow variation.

According to another aspect of the present invention, there is provided a heat exchanger comprising a plurality of tubes through which refrigerants flow, the tubes being spaced away from each other at a predetermined distance; and a plurality of fins spaced away from each other at a predetermined distance, each of the fins comprising first airflow guide means formed in a flat base to guide air induced into a fin collar region through which the tubes are perpendicularly inserted and second airflow guide means having peak and valley portions that are alternately disposed to provide airflow variation.

According to still another aspect of the present invention, there is provided a heat exchanger comprising at least two rows of tubes through which refrigerant flows, the tubes being disposed in a zigzag-shape; and a plurality of fins through which the tubes perpendicularly penetrate, wherein each of the fins comprises first airflow guide means for guiding air flowing around the tube up to a rear end of the tube with a uniform airflow speed distribution, the first airflow guide means comprising two arc-shaped flat bases that are symmetrically disposed around the tube; and second airflow guide means for providing airflow variation, the second airflow guide means comprising peak and valley portions and inclined sections connecting the peak and valley portions.

It is to be understood that both the foregoing general description and the following detailed description of the present invention are exemplary and explanatory and are intended to provide further explanation of the present invention as claimed.

BRIEF DESCRIPTION OF THE DRAWINGS

The accompanying drawings, which are included to provide a further understanding of the present invention and are incorporated in and constitute a part of this application, illustrate embodiment(s) of the present invention and together with the description serve to explain the principle of the present invention. In the drawings.

DETAILED DESCRIPTION OF THE PREFERRED EMBODIMENTS

Reference will now be made in detail to the preferred embodiments of the present invention, examples of which are illustrated in the accompanying drawings. Wherever possible, the same reference numbers will be used throughout the drawings to refer to the same or like parts.

Figure 1:
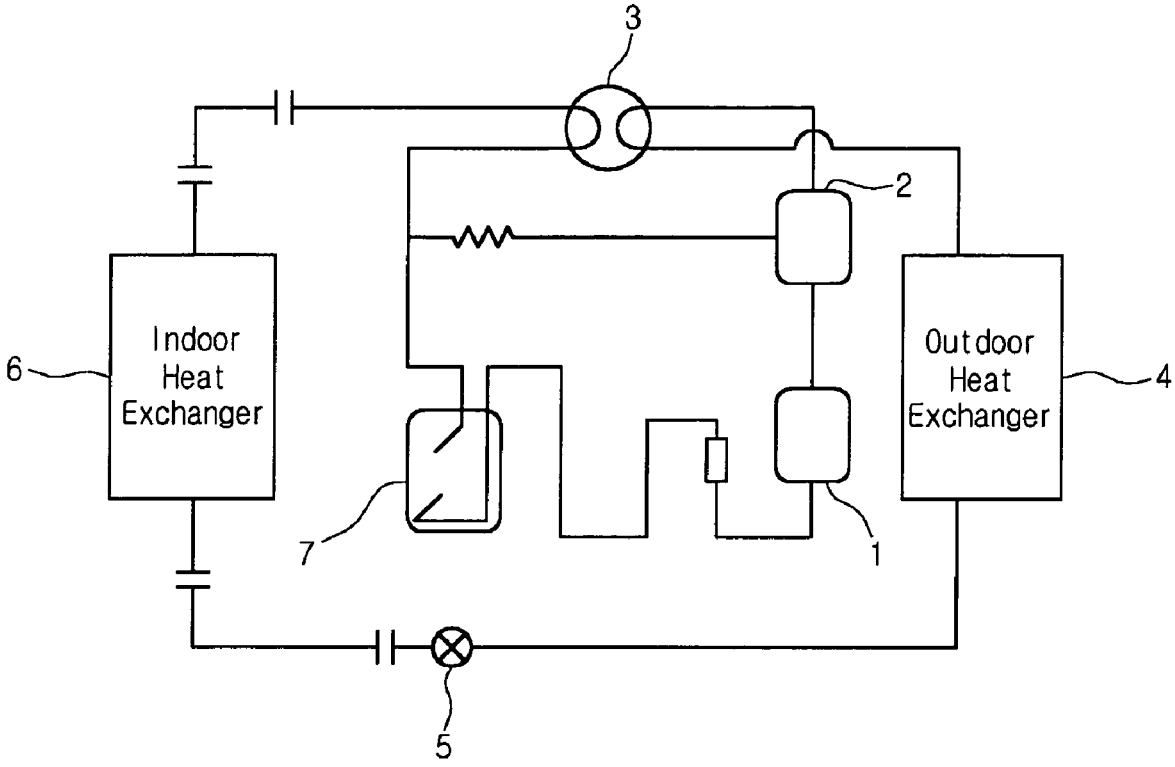
Fig.1 Related Art
FIG. 1 is a schematic view of a conventional heat pump type air conditioner.
Figure 2:
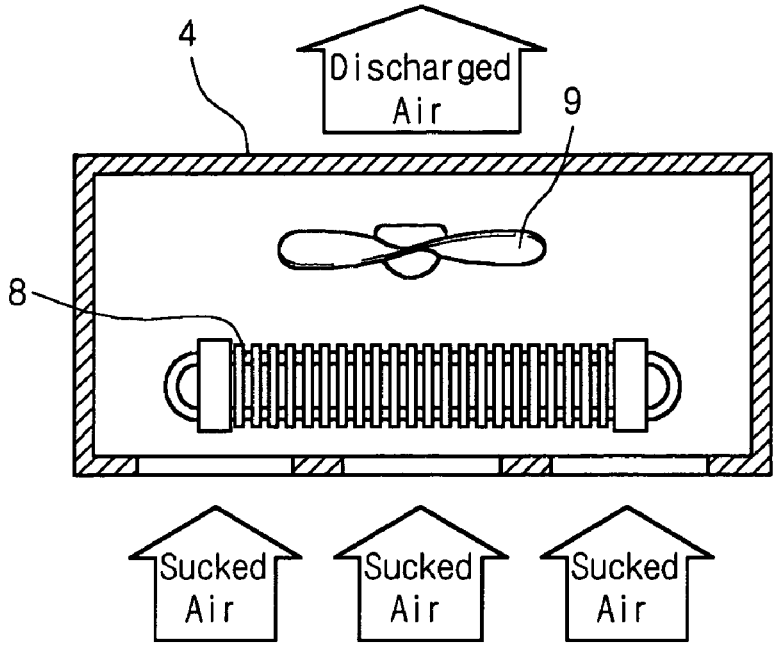
Fig.2 Related Art
FIG. 2 is a schematic view of a conventional heat exchanger.
Figure 3:
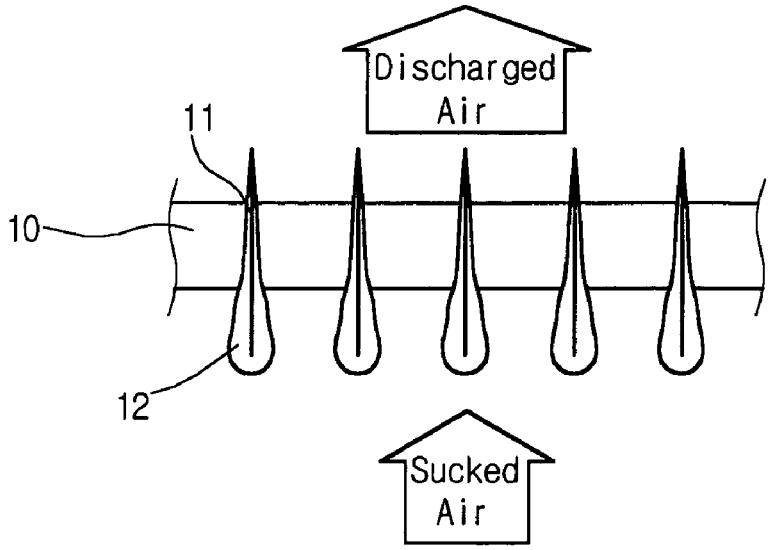
Fig.3 Related Art
FIG. 3 is a view illustrating a flat fin on which frost is formed.
Figure 4:
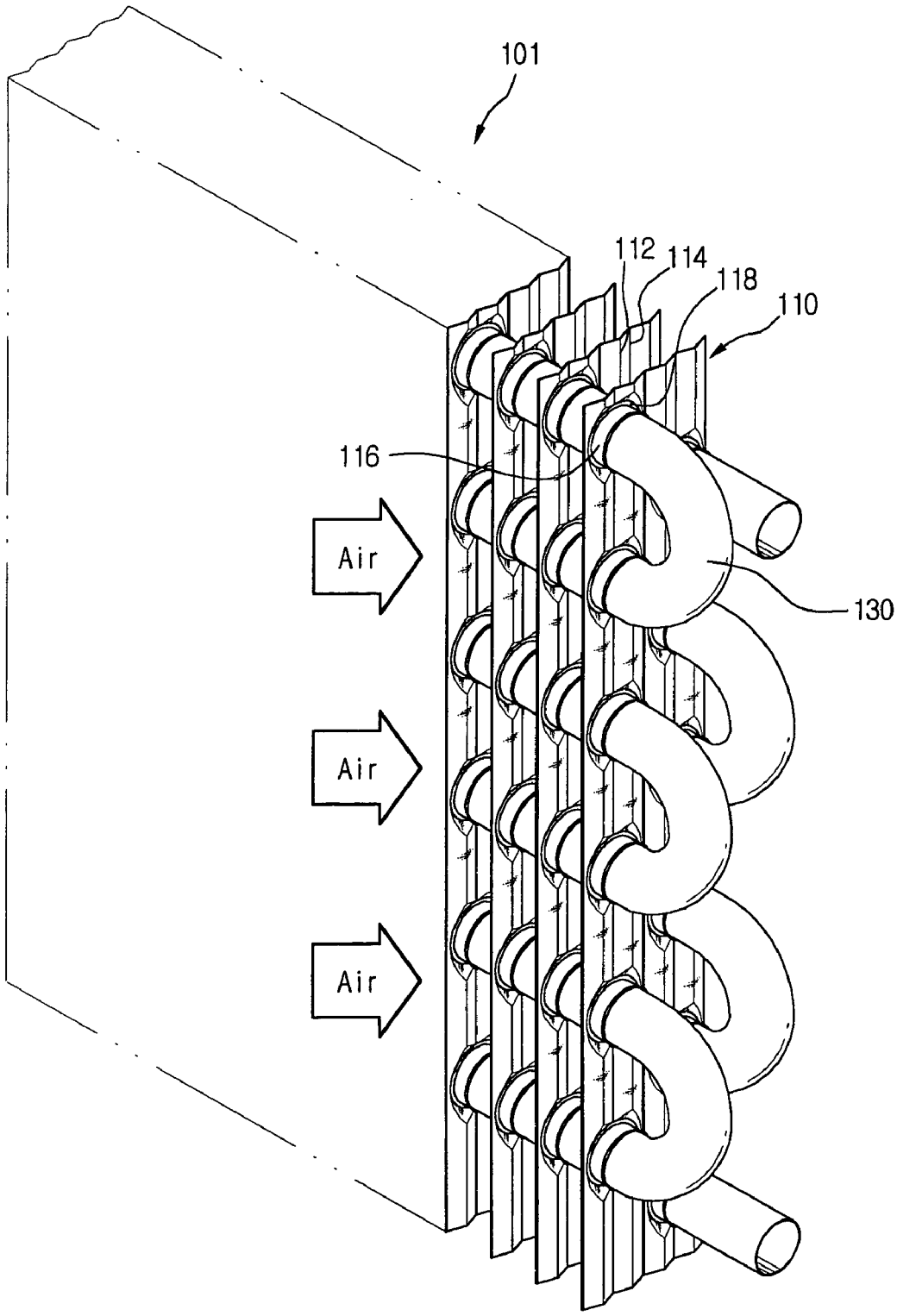
Fig.4 Related Art
FIG. 4 is a perspective view of a conventional corrugate fin type heat exchanger.
Figure 5:
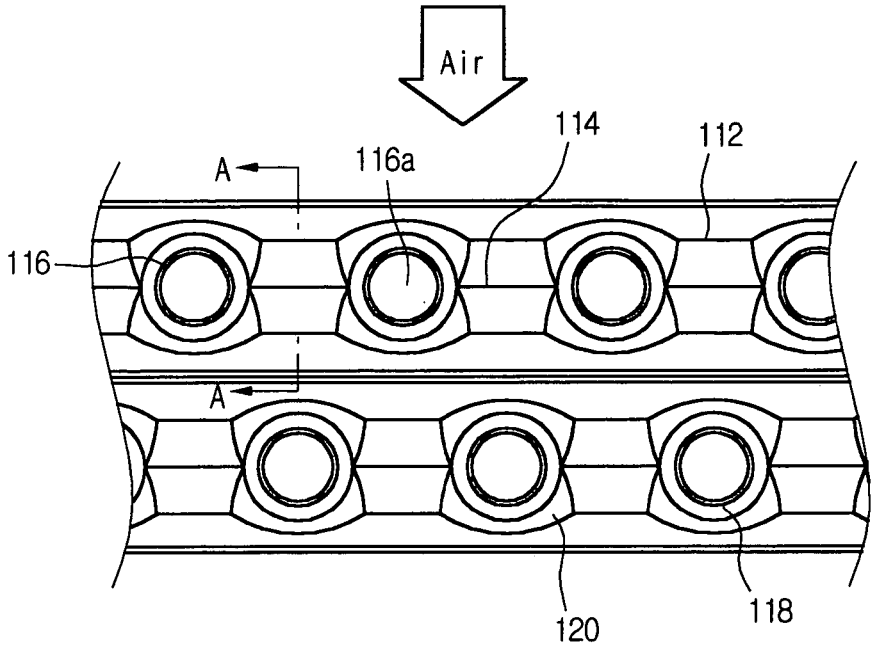
Fig.5 Related Art
FIG. 5 is a plane view of a corrugate fin depicted in FIG. 4.
Figure 6:
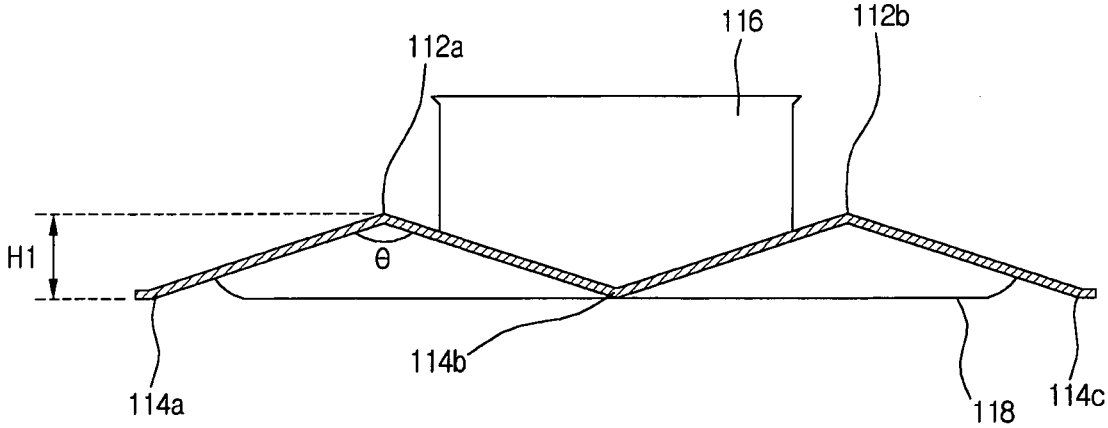
Fig.6 Related Art
FIG. 6 is a sectional view taken along the line A–A' of FIG. 5.
Figure 7:
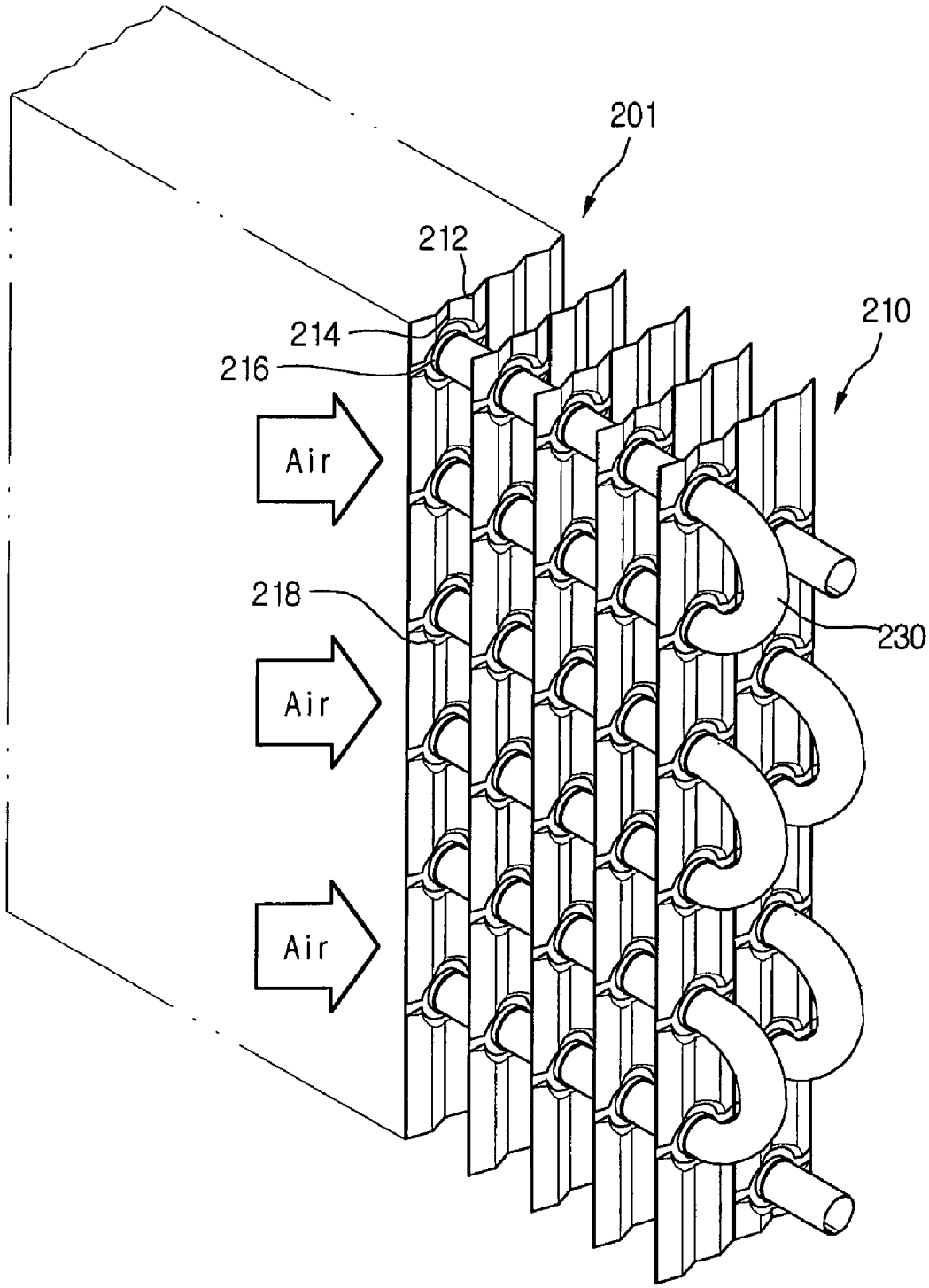
FIG. 7 is a perspective view of a heat exchanger according to an embodiment of the present invention.

Referring to FIG. 7, a heat exchanger 201 includes a plurality of fins 210 spaced away from each other at a predetermined distance and a plurality of tubes 230, along which a refrigerant flow, disposed perpendicularly penetrating the fins 210 and spaced away from each other at a predetermined distance.

Figure 9:
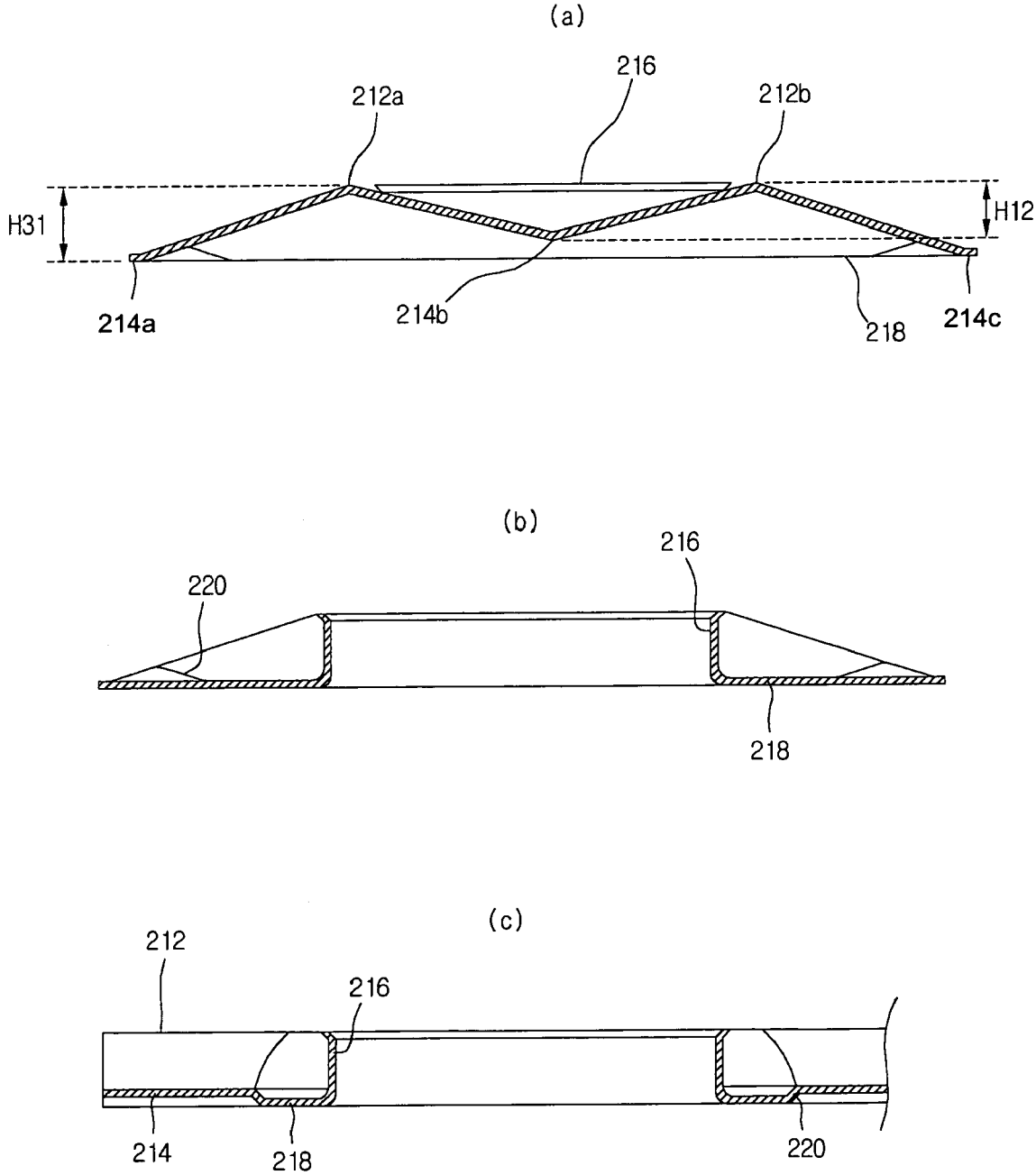
FIG. 9A is a sectional view taken along the line B–B' of FIG. 7.
FIG. 9B is a sectional view taken along the line C–C' of FIG. 7.
FIG. 9C is a sectional view taken along the line D–D' of FIG. 7.

As shown in FIGS. 9A to 9C, the fin 210 includes peak and valley portions 212 and 214 that are alternately formed and connected to each other by inclined sections, collar portions 216 defining a tube insertion holes 216*a* through which the tubes 230 are inserted, longitudinal axes of the tubes being perpendicularly penetrating a longitudinal centerline of the fin 210, and seat portions 218 for supporting the fin collar portions 116. An inclined portion 220 is formed extending from an outer circumference of the seat portion 218 to the peak portions 212 to connect the seat portion 218 to the peak and valley portions 212 and 214.

That is, each of the fins 210 has the first and second peak potions 212 (212*a* and 212*b*) and the first, second and third valley portions 214 (214*a*, 214*b* and 214*c*). The peak and valley portions 212 and 214 are alternately formed and connected to each other by longitudinal inclined sections.

Figure 10:
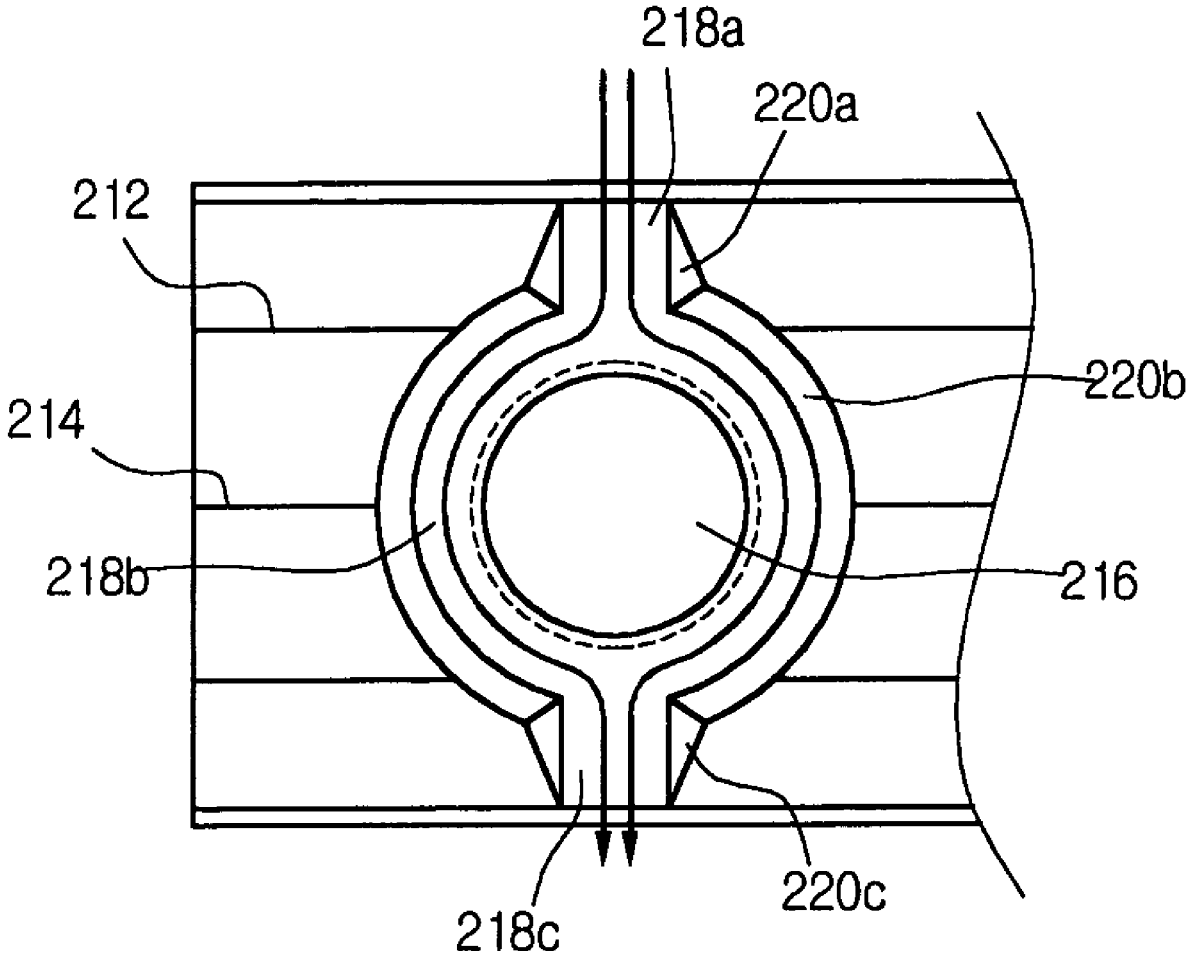
FIG. 10 is a detailed view of a seat portion depicted in FIG. 7.

As shown in FIG. 10, each of the seat portions 218 includes a flat base air inlet and outlet channels 218*a* and 218*c* and a flat base airflow guide channel 218*b* connecting the air inlet and outlet portions 218*a* and 218*c* to each other. The flat base airflow guide channel 218*b* is formed in a concentric circle around a lower end of an outer circumference of the fin collar 216.

The inclined portion 220 is formed extending from the outer circumference of the seat portion 218.

In order to provide airflow variation, a depth of the second valley portion 214*b* is lower than those of the first and third valley portions 214*a* and 214*c*.

The heat exchanger of the present invention will be described more in detail in conjunction with the accompanying drawings.

As shown in FIGS. 5 to 10, the heat exchanger 201 includes the W-shaped corrugate fins 210 through which the tubes 230 are perpendicularly inserted, being spaced away from each other at a predetermined distance.

Each of the fins 210 is divided into fin collar regions through the tubes 230 penetrate and inclined section regions defined between the fin collar regions. The peak and valley portions are formed in the inclined section regions.

The depth and heights of the valley and peak portions 214 and 212 are designed to be different from each other to provide the airflow variation.

Figure 8:
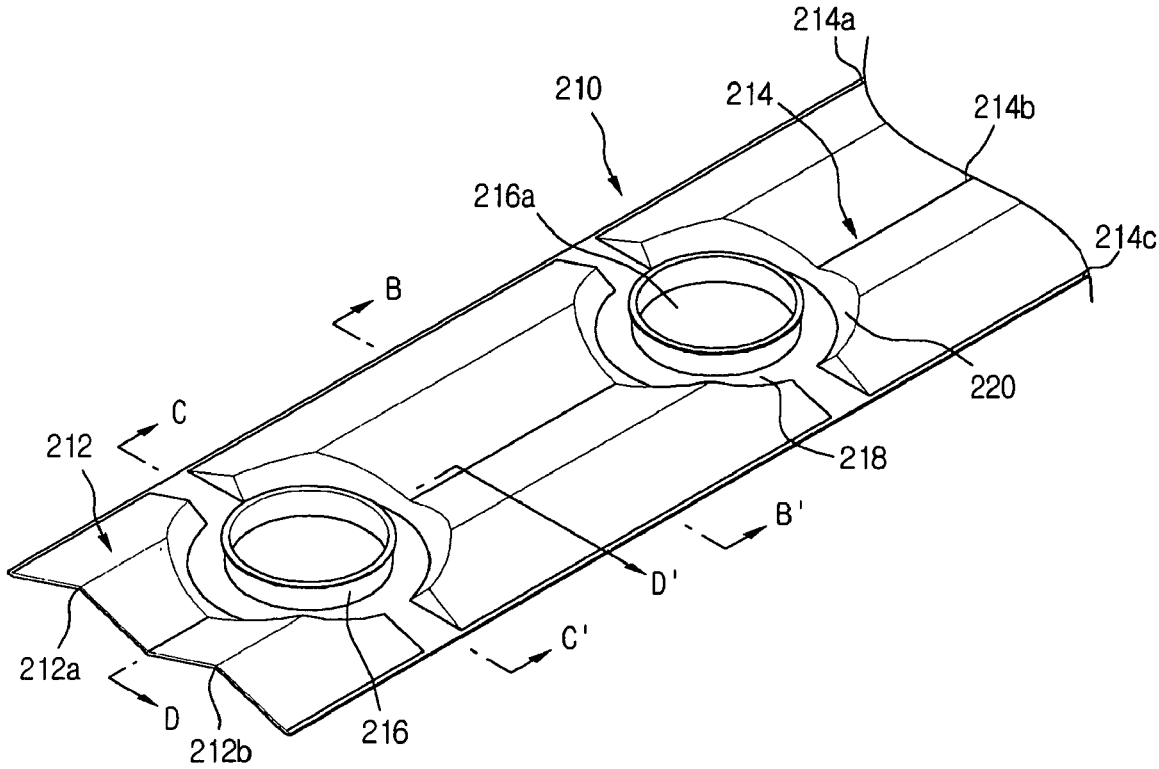
FIG. 8 is a perspective view of a fin depicted in FIG. 7.

Referring to FIG. 8, the peak portions 212 (212*a* and 212*b*) are connected to the respective valleys portions 214 (214*a*, 214*b* and 214*c*) by the longitudinal inclined sections whose inclined angles are different from each other. For effectively inducing and exhausting the air, both side ends of the fin 210 are defined by the valley portions 214*a* and 214*c*. The valley portion 214*b* is formed on a longitudinal centerline of the fin 210, and the peak portions 212*a* and 212*b* are respectively formed between the first and second valley portions 214*a* and 214*b* and between the second and third valley portions 214*b* and 214*c*.

That is, the fin 210 is designed to be symmetrical with reference to the center valley portion 214*b*. The number of peak and valley portions may be varied.

As shown in FIGS. 8, 9A, 9B and 9C, the peak portions 212*a* and 212*b* are located on a first horizontal plane, and a depth H12 from the first horizontal plane to the valley portion 214*b* is smaller than those H31 of the first and third valley portions 214*a* and 214*c*.

In addition, the fin collars 216 are elevated to a predetermined height, defining tube insertion holes 216*a* through which the tubes are inserted. The height of the fin collar 216 may be higher or lower than the peak portions 212.

In order to minimize the airflow-resistance, the seat portion 218 formed around the lower end of the fin collar 216 is formed to be flat having a horizontal plane identical to or lower than that where the valley portions 214*a* and 214*b* are located.

As a modified example, heights and depths of the peak portions 212 and the valley portions 214 may be designed to be different from each other. Furthermore, the number of the peak portions 212 and the valley portions 214 are preferably over 2 and 3. Fins are arranged in two or more rows for disposing tubes in a zigzag structure.

As another modified example, in order to increase the airflow speed along the fins, the heights of the peak portions may be gradually reduced as they go to the longitudinal centerline of the fin, or the depth of the valley portions maybe gradually reduced as they go to the longitudinal centerline of the fin.

Meanwhile, as shown in FIGS. 8 and 10, the seat portion 218 has the flat base air inlet channel 218*a* through which outdoor air is induced, the flat base airflow guide channel 218*b* for guiding the air along the outer circumference of the fin collar 216, and the flat base air outlet channel 218*c* through which the air is exhausted.

That is, the seat portion 218 is designed such that the air is induced to the fin collar 216 through which the tube is inserted without receiving any flow-resistance and is then, after it is heat-exchanged with the tube, exhausted without receiving any resistance.

That is, bases of the inlet and outlet channels 218*a* and 218*c* and the airflow guide channel 218*b* are located on an identical horizontal plane. The inlet and outlet channels 218*a* and 218*c* are formed in a straight channel type to allow the air to straightly flow and the airflow guide channel 218*b* is formed in a circular channel type to allow the air to flow to the outlet channel 218*c* along a gentle curved line.

In addition, the inlet and outlet channels 218*a* and 218*c* are designed having a width less than an outer diameter of the fin collar, but equal to or greater than that of the airflow guide channel 218*b*. Therefore, the inclined portions 220 defining an outer wall of the seat portion 218 have a predetermined inclined angle, connecting the seat portion 218 to the peak and valley portions 212 and 214.

The inclined portions 220 includes straight guide sections 220*a* and 220*c* defining sidewalls of the inlet and outlet channels 218*a* and 218*b* and arc-shaped guide sections 220*b* defining a sidewall of the airflow guide channel 218*b* to allow the air to flow along arc-shaped lines.

Accordingly, the inlet and outlet channels 220*a* and 220*c* allow the air to straightly flow to maintain its flow speed, while preventing the air from getting out of the fin collar region.

The arc-shaped guide sections 220*b* are inclined at a predetermined angle, defining the sidewall of the airflow guide channel 220*b* to guide the air to flow along the arc-shaped lines without getting out of the fin collar region. To this end, the airflow guide channel 218*b* is connected to the peak and valley portions 212*a*, 212*b* and 214*b* by the arc-shaped guide sections 220*b* having a curvature corresponding to an outer circumference of the seat portion 218

When high-speed air is induced into the seat portion 218, the air flows up to the rear end of the tube along the straight guide sections 220*a* and the curved guide section 220*b*. At this point, the rear straight guide sections 220*a* prevent the high-speed air from being accumulated at the rear end of the tube, thereby guiding the high-speed air to the next tube. That is, the flat base air inlet and outlet channels and the flat base airflow guide channel allow the air to flow up to the rear end of the tube at a high-speed, while going around the tube.

In addition, the inclined portions 220 connecting the seat portion 218 to the center valley portion 214*b* functions as a guider for guiding the air going around the tube to flow up to the rear end of the tube. The air flowing to the rear end of the tube agitates air accumulated on the rear end of the tube, thereby reducing the wake region formed on the rear end of the tube, which has a relatively low heat transmission efficiency.

In addition, the air inlet and outlet channels 218*a* and 218*c* allow the air flowing around the tube to effectively flow up to the rear end of the tube.

That is, since the bases of the air inlet and outlet channels 218*a* and 218*c* are located on a horizontal plane identical to or lower than that where the base of the airflow guide channel 218*b* are formed, the airflow-resistance that may occur while the air passes through the seat portion 218 is minimized. Likewise, the airflow-resistance occurring when the air flowing around the tube flows to the air outlet channel 218 can be also minimized. Therefore, The air can flow with the minimized airflow-resistance in the current row of fins, which is then directed to the next row of fins, minimizing the deterioration of the heat exchange efficiency.

Figure 11:
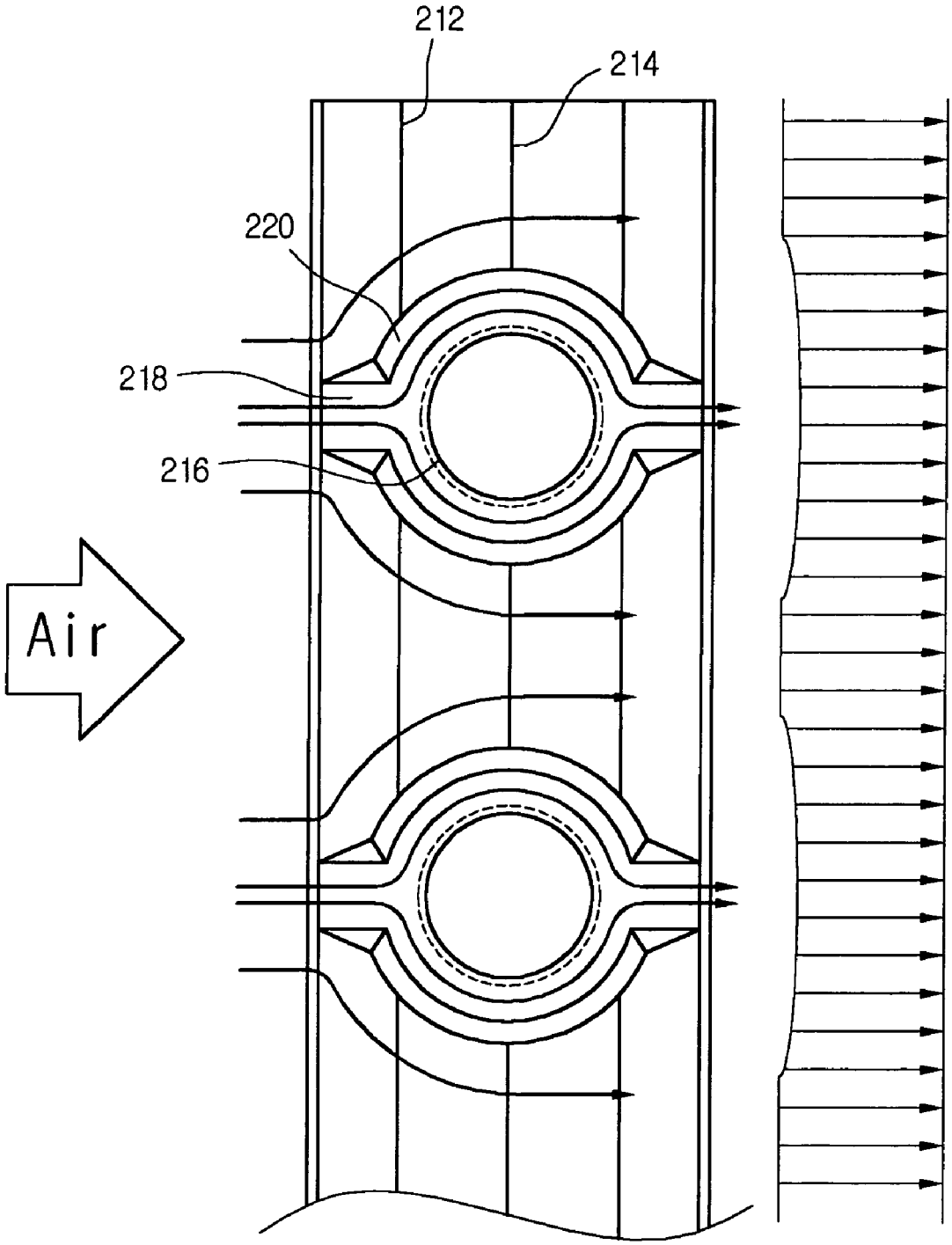
FIG. 11 is a view illustrating an airflow state along a single fin structure of the present invention.
Figure 12:
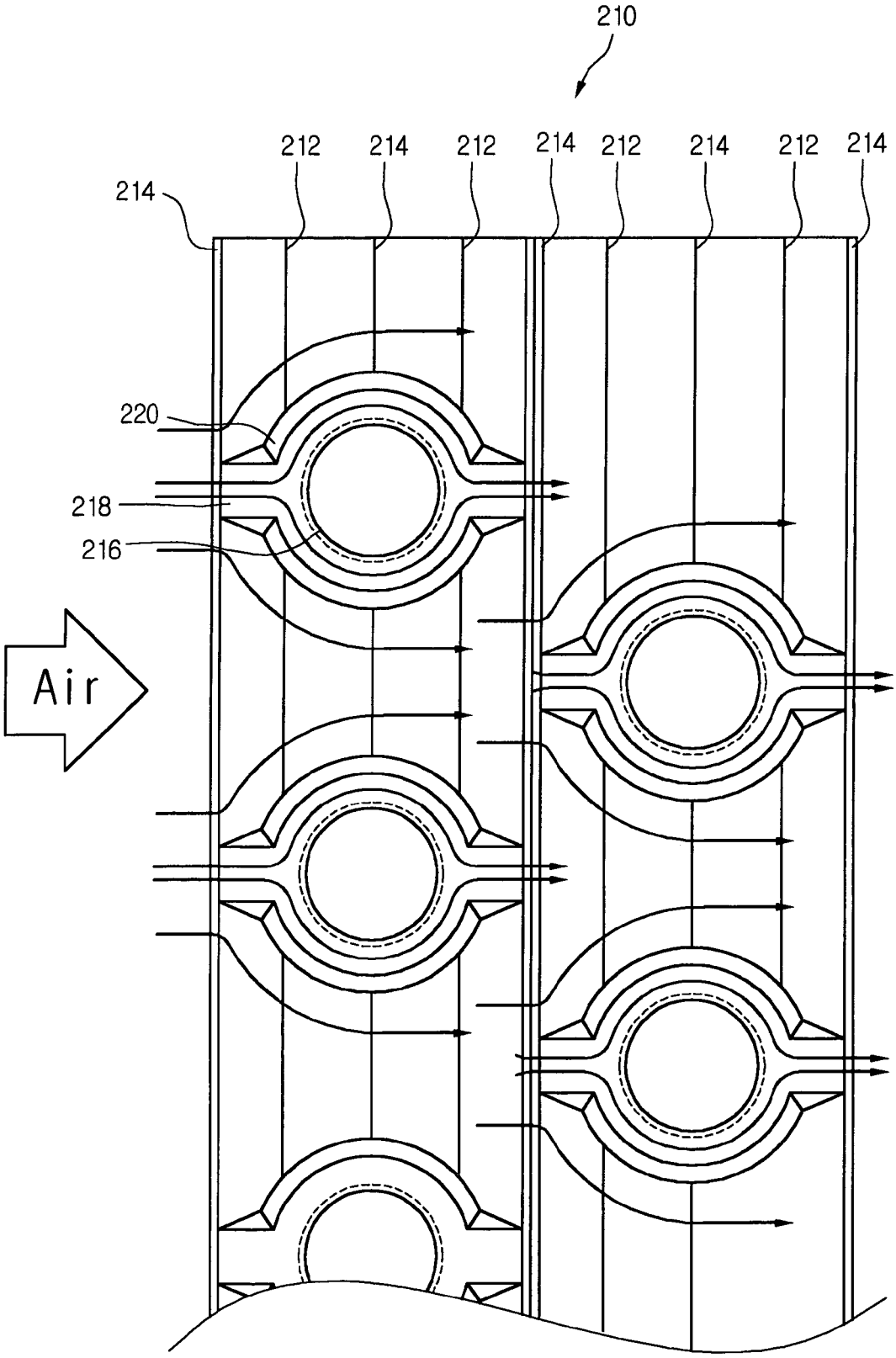
FIG. 12 is a view illustrating an airflow state along a multiple fin structure of the present invention.

FIGS. 11 and 12 show a flow state of air passing through the inventive heat exchanger.

As described above, the fin 210 is designed such that the depth of the longitudinal center valley portion is lower than those of other valley portions, the lateral front and rear sides of the seat portion of the fin collar area are opened, and the base of the seat portion is formed to be lower than the center valley portion. As a result, the flow variation of the air passing between the fins is increased when compared with the conventional art, thereby reducing the pressure drop for the high-speed airflow and increasing the heat transfer efficiency.

Furthermore, even when the fin is formed in a dual fin structure as shown in FIGS. 7 and 12, the air passes between the adjacent fins without being accumulated on the real end of the tube. That is, the airflow speed distribution becomes uniform throughout the entire surface of the fin. Thereby, the heat exchange efficiency of a next fin is improved. That is, by the air inlet and outlet channels and the airflow guide channel formed around the tube, the air can be effectively guided up to the rear end of the tube.

When the air is introduced into a space defined between the fins, since the air flows around the tube with the increased flow speed by a small gap defined by the tubes, the air pressure may be dropt, increasing the airflow-resistance.

However, as shown in FIGS. 7, 11 and 12, by the channels formed on the seat portion, the air can be guided up to the rear end of the tube along the inclined portion 220 and the seat portions without getting out of the circumference of the tube.

As described above, the heat exchanger of the present invention has an advantage of reducing the wake region formed on the lateral rear end of the fin when the intake air flows around the fin collar area.

As the wake region is reduced, the air accumulation problem can be solved, and the airflow-resistance is reduced. Furthermore, since the airflow speed distribution at the next row of the fins becomes uniform, the heat exchange efficiency of the next row of the fins can be improved.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A heat exchanger comprising:

a plurality of tubes through which refrigerants flow, the tubes being spaced away from each other at a predetermined distance; and a plurality of corrugated fins spaced away from each other at a predetermined distance, each of the corrugated fins including:

a plurality of peaks and a plurality of valleys alternately arranged along a first direction;

a plurality of fin collars through which the tubes are inserted, each of the fin collars being located in between two immediately adjacent peaks along the first direction;

a plurality of seat portions, each of the seat portions being located around an outer circumferences of the corresponding fin collars and having a first end for receiving air and a second end for discharging the air, each of the seat portions being a substantially flat area lower than a valley between the two immediately adjacent peaks.

2. The heat exchanger according to claim 1, wherein the valleys are located on a horizontal plane, and heights from the horizontal plane to the peaks are different from each other.

3. The heat exchanger according to claim 1, wherein the peaks are located on a horizontal plane, and depths from the horizontal plane to the valleys are different from each other.

4. The heat exchanger according to claim 3, wherein the valley between the two adjacent peaks has a depth smaller than another valley immediately adjacent to the valley between the two adjacent peaks, the depth being measured from one of the two adjacent peaks.

5. The heat exchanger according to claim 1, wherein each of the seat portions comprises:

a substantially flat base air inlet channel extending from the first end of the corresponding seat portion toward the corresponding fin collar;

a substantially flat base air outlet channels extending from the second end of the corresponding seat portion toward the corresponding fin collar; and a substantially flat base airflow guide channel for communication the substantially flat base air inlet and outlet channels, the flat base airflow guide channel being located around the outer circumference of the corresponding fin collar.

6. The heat exchanger according to claim 5, wherein the substantially flat base air inlet channel, the substantially flat base air outlet channel and the substantially flat base airflow guide channel are substantially coplanar.

7. The heat exchanger according to claim 5, wherein sidewalls of the channels are defined by an inclined portions connecting the corresponding seat portion to the corresponding peaks and valleys.

8. The heat exchanger according to claim 5, wherein widths of the substantially flat base air inlet and outlet channels are substantially identical to each other.

9. The heat exchanger according to claim 5, wherein widths of the substantially flat base air inlet and outlet channels are smaller than an outer diameter of the corresponding fin collar, but are substantially equal to or greater than that of the airflow guide channel.

10. The heat exchanger according to claim 7, wherein the inclined portions are comprised of a first straight guide section defining the sidewall of the substantially flat base air inlet channel to guide inducement of the air, an arc-shaped guide section defining the sidewall of the substantially flat base airflow guide channel to guide the air flowing around the corresponding tube, and a second straight guide section defining the sidewall of the substantially flat base air outlet channel to guide exhaustion of the air.

11. The heat exchanger according to claim 10, wherein a first valley and a second valley being immediately adjacent to the valley between the two adjacent peaks, wherein the first straight guide section is formed in a triangular surface defined by connecting a first point formed on the first valley to a second point formed on a middle portion of a line connecting the first valley to one of the two immediately adjacent peaks adjacent to the first valley and by connecting the second point to a third point where a horizontal line where the first valley is located intersects a vertical line passing through the second point, and the second straight guide section is formed in a triangular surface defined by connecting a fourth point formed on the second valley to a fifth point formed on a middle portion of a line connecting the second valley to the other one of the two immediately adjacent peaks adjacent to the second valley and by connecting the fifth point to a sixth point where a horizontal line where the second valley is located intersects a vertical line passing through the fifth point.

12. The heat exchanger according to claim 4, wherein each of the seat portions is substantially coplanar with the another valley immediately adjacent to the valley.

13. The heat exchanger according to claim 5, wherein the first end of each of the seat portions is located where a first valley immediately adjacent to the valley between the two adjacent peaks is located, and the second end of each of the seat portions is located where a first valley immediately adjacent to the valley between the two adjacent peaks is located.

14. The heat exchanger according to claim 10, wherein the arc-shaped guide section is formed along an outer curvature of the corresponding tube and connected to the corresponding peaks and valleys at a predetermined inclined angle.

15. A heat exchanger comprising:

a plurality of tubes through which refrigerants flow, the tubes being spaced away from each other at a predetermined distance; and a plurality of corrugated fins spaced away from each other at a predetermined distance, each of the corrugated fins including:

a plurality of peaks and a plurality of valleys alternately arranged along a first direction;

a plurality of fin collars through which the tubes are inserted, each of the fin collars being located in between two immediately adjacent peaks along the first direction; and a plurality of seat portions, each of the seat portions including:

an inlet channel for receiving air;

an outlet channel for discharging the air; and a surrounding channel surrounding an outer circumference of the corresponding fin collar and connecting the inlet channel and the outlet channel;

wherein the inlet channel, the outlet channel and the surrounding channel are substantially coplanar and are lower than a valley between the two immediately adjacent peaks.

16. The heat exchanger according to claim 15, further comprising an inclined portion corresponding to each of the seat portions, wherein the inclined portion includes a first straight guide section defining a sidewall of the inlet channel to guide inducement of the air, an arc-shaped guide section defining a sidewall of the surrounding channel to guide the air flowing around the corresponding tube, and a second straight guide section defining a sidewall of the outlet channel to guide exhaustion of the air.

17. A heat exchanger, comprising:

a plurality of tubes through which refrigerants flow, the tubes being spaced away from each other at a predetermined distance; and a plurality of corrugated fins spaced away from each other at a predetermined distance, each of the corrugated fins including:

a plurality of peaks and a plurality of valleys alternately arranged along a first direction;

a plurality of fin collars through which the tubes are inserted, each of the fin collars being located in between two immediately adjacent peaks along the first direction; and a plurality of seat portions, each of the seat portions including:

an inlet channel for receiving air;

an outlet channel for discharging the air; and a surrounding channel surrounding an outer circumference of the corresponding fin collar and connecting the inlet channel and the outlet channel; and a plurality of inclined portions respectively corresponding to each of the seat portions, wherein the inclined portion includes a first straight guide section defining a sidewall of the inlet channel to guide inducement of the air, an arc-shaped guide section defining a sidewall of the surrounding channel to guide the air flowing around the corresponding tube, and a second straight guide section defining a sidewall of the outlet channel to guide exhaustion of the air.

18. A heat exchanger, comprising:

a plurality of tubes through which refrigerants flow, the tubes being spaced away from each other at a predetermined distance; and a plurality of fins spaced away from each other at a predetermined distance, each of the fins having fin collars through which the tubes are perpendicularly inserted, seat portions each concentrically formed around outer circumferences of the fin collars and provided with laterally-opened front and rear portions, more than two peak portions, and more than two valley portions, the peak and valley portions being alternately disposed to provide airflow variation;

wherein sidewalls of the channels are defined by inclined portions connecting the seat portion to the peak and valley portions; and wherein the inclined portions are comprised of a first straight guide section defining the sidewall of the flat base air inlet channel to guide inducement of the high-speed air, an arc-shaped guide section defining the sidewall of the flat base airflow guide channel to guide the air flowing around the tube, and a second straight guide section defining the sidewall of the flat base air outlet channel to guide exhaustion of the air.

19. The heat exchanger according to claim 18, wherein the valley portions are comprised of first, second and third valley portions, the second valley portion being disposed between the first and third valley portions, wherein the first straight guide section is formed in a triangular surface defined by connecting a first point formed on the first valley portion to a second point formed on a middle portion of a line connecting the first valley to the peak portion adjacent to the first valley portion and by connecting the second point to a third point where a horizontal line where the first valley portion is located intersects a vertical line passing through the second point, and the second straight guide section is formed in a triangular surface defined by connecting a fourth point formed on the third valley portion to a fifth point formed on a middle portion of a line connecting the third valley to the peak portion adjacent to the third valley portion and by connecting the fifth point to a sixth point where a horizontal line where the third valley portion is located intersects a vertical line passing through the fifth point.

20. The heat exchanger according to claim 18, wherein the arc-shaped guide section is formed along an outer curvature of the tube and connected to the peak and valley portions at a predetermined inclined angle.

* * * * *